US008610374B2

(12) United States Patent
Van Den Biggelaar

(10) Patent No.: US 8,610,374 B2
(45) Date of Patent: Dec. 17, 2013

(54) LAMP UNIT WITH A PLURALITY OF LIGHT SOURCE AND TOGGLE REMOTE CONTROL METHOD FOR SELECTING A DRIVE SETTING THEREFOR

(75) Inventor: Theodorus Johannes Petrus Van Den Biggelaar, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 128 days.

(21) Appl. No.: 13/392,886

(22) PCT Filed: Sep. 9, 2010

(86) PCT No.: PCT/IB2010/054071

§ 371 (c)(1),
(2), (4) Date: Feb. 28, 2012

(87) PCT Pub. No.: WO2011/036595

PCT Pub. Date: Mar. 31, 2011

(65) Prior Publication Data

US 2012/0153867 A1 Jun. 21, 2012

(30) Foreign Application Priority Data

Sep. 23, 2009 (EP) ..... 09171036

(51) Int. Cl.
*H05B 37/02* (2006.01)

(52) U.S. Cl.
USPC ..... 315/294; 315/323; 315/360

(58) Field of Classification Search
USPC ..... 315/294, 312, 360, 323
See application file for complete search history.

(56) References Cited

U.S. PATENT DOCUMENTS

| | | | | |
|---|---|---|---|---|
| 6,028,441 | A * | 2/2000 | Alvord et al. | 324/750.3 |
| 6,801,003 | B2 | 10/2004 | Schanberger et al. | |
| 2003/0048632 | A1 | 3/2003 | Archer | |
| 2006/0273741 | A1 | 12/2006 | Stalker | |
| 2007/0064419 | A1 | 3/2007 | Gandhi | |
| 2008/0297068 | A1 | 12/2008 | Koren et al. | |
| 2010/0225238 | A1 * | 9/2010 | Medin et al. | 315/210 |
| 2012/0062138 | A1 * | 3/2012 | Wilson et al. | 315/254 |

FOREIGN PATENT DOCUMENTS

| | | | |
|---|---|---|---|
| DE | 29904988 | U1 | 3/1999 |
| DE | 10201131 | A1 | 1/2002 |
| WO | 0184688 | A2 | 11/2001 |

* cited by examiner

*Primary Examiner* — Don Le
(74) *Attorney, Agent, or Firm* — Mark L. Beloborodov

(57) ABSTRACT

The present invention relates to a lamp unit (100) in which a plurality of light sources (120*a-e*) are controlled by means of a control unit (110) which is adapted to control a sequence of drive settings (Sa-e) for the plurality of light sources based on a switching signal ($S_{in}$) supplied to the lamp unit. The control unit is arranged such that depending on the elapsed time between deactivation of and subsequent reactivation of the switching signal, the control unit sets the current drive settings in a predetermined manner. Within a first predetermined time interval a subsequent drive setting of the light sources is employed, after a second predetermined time interval a previous drive setting of the light sources is employed, and within an intermediate time interval, arranged between the end of the first predetermined time interval and the end of the second predetermined time interval a predetermined drive setting is employed.

15 Claims, 3 Drawing Sheets

| ⊗ | Sequence (Sa,Sb,Sc,Sd) | | | | | | |
|---|---|---|---|---|---|---|---|
| 200 | 000 | 001 | 010 | 100 | 101 | 011 | 111 |
| 200´ | 0001 | 0101 | 1001 | 1010 | 1111 | | |
| 200´´ | 010<br>001<br>100 | 110<br>011<br>101 | 111<br>000<br>100 | 101<br>101<br>101 | 110<br>101<br>011 | 010<br>101<br>111 | |

LAMP UNIT WITH A PLURALITY OF LIGHT SOURCE AND TOGGLE REMOTE CONTROL METHOD FOR SELECTING A DRIVE SETTING THEREFOR

FIELD OF THE INVENTION

The present invention relates to a lamp unit comprising a plurality of light sources and a control unit adapted to control a sequence of drive settings for the light sources based on a switching signal supplied to the lamp unit, and a corresponding method for controlling a plurality of light sources based on a switching signal.

BACKGROUND OF THE INVENTION

It is known to manipulate the drive settings of a number of light sources by selecting a current drive setting by means of turning the power switch on and off in a particular manner. US 2007/0064419 A1 discloses a method for controlling the drive settings of one or more LED lights in order to provide different color states by means of a control unit and a time sensitive on-off switching method. The color states are governed by a sequence of drive settings of the LED lights. By turning the power switch off and on again within a predetermined time limit, the switching time, the next drive setting in the sequence of drive settings is set. Thus a user may switch from color state to color state by repeatedly turning the power off and on within the switching time. Within a second predetermined time limit, the synchronize time, the last completed selection of a state by the user is set. Thus, to select a desired color state the user simply leaves the system on until the end of the synchronize time. Further, the method provides storing of the present state of operation and color and color combination when switched off, and restoration of the drive settings at the time of the next time the lights are switched on.

Time sensitive on-off switching methods for controlling the light from an armature offers flexibility for the user to select different light settings in a room in a convenient way. However, when a lighting system comprises a plurality of armatures governed by such a method, there is a risk that an excessive number of color states are possible and that the current color states of the armatures may be displaced with respect to each other, e.g. when the lighting system is turned on.

SUMMARY OF THE INVENTION

It is an object of the present invention to overcome this problem, and to provide an improved method for controlling a plurality of lights based on on-off switching. The method is used in a light emitting device and a corresponding luminaire and system.

According to a first aspect of the invention, this and other objects are achieved by means of a lamp unit comprising a plurality of light sources and a control unit adapted to control a sequence of drive settings for the plurality of light sources based on a switching signal supplied to the lamp unit. The control unit is arranged such that: if the switching signal is deactivated and within a first predetermined time interval is subsequently reactivated, a subsequent drive setting of the light sources is employed, or else if the switching signal is deactivated and after a second predetermined time interval, is subsequently reactivated, a previous drive setting of the light sources is employed, or else if the switching signal is deactivated and within a predetermined first intermediate time interval, arranged between the end of the first predetermined time interval and the end of the second predetermined time interval, is subsequently reactivated, a predetermined drive setting is employed. Thus, there is provided a lamp unit which is responsive to a switching signal such that a user may advantageously select a desired drive setting of the light sources by generating alternating off- and on switching signals. The change in drive setting may be chosen to be the next drive setting or a previously selected drive setting, i.e. the user may step through the different choices or return to the a previously selected drive setting. The time interval between changes of the off-on state of the switching signal will determine the drive setting and thus the light output of the lamp. Further, by providing the first intermediate time interval, resetting of the light sources to a predetermined color or lighting state is accomplished which is advantageous when having a large number of states in the sequence of drive settings of the lamp unit. Further, when a plurality of lamp units are employed, e.g. in a luminaire or as light spots in a room, and responding to a common switching signal, it is possible that the individual lamp units are unintentionally in different states, e.g. outputs light of different colors or directions, when the power is switched on. With the present inventive concept, the possibility of resetting the lamp units to a predetermined state, e.g. to have the same color, is achieved by after switching off the lamp units turning them on within the first intermediate time interval. Hence, the lamp units are in this way synchronized with respect to each other in a certain predetermined manner.

According to an embodiment of the lamp unit, the control unit is further arranged such that if the switching signal is deactivated and within a predetermined second intermediate time interval, arranged between the end of said first predetermined time interval and the first intermediate time interval, is subsequently reactivated, a second predetermined drive setting is employed. Thus, the lamp unit may be reset to several predetermined drive settings determined by the operation of the switching signal, which is advantageous when different types of optical/lighting effects are desired. For instance the lamp unit may have more than one major functionality, e.g. one for projecting a light pattern on a wall and one for providing atmosphere, than it can be desirable to reset merely one of the functionalities.

According to an embodiment of the lamp unit, the light sources are adapted to emit light of different colors, whereby the present inventive concept advantageously provides a manner for altering the present overall color state for the lamp unit. The sequence of drive settings may be chosen to power the differently colored light sources such that different desired color combinations are achieved. The lighting of a space may in this way be altered to provide a desired atmosphere, e.g. changing from a working light to a romantic light, in a user friendly way.

According to an embodiment of the lamp unit, the switching signal is supplied by means of a power switch, or a remote control and a corresponding receiver arranged in the lamp unit. Thus, the power switch of a luminaire in which the lamp unit is mounted, or a remote control may be used to provide the switching signal. In the later case, the lamp unit or a luminaire in which the lamp unit is mounted is further arranged with means for receiving such remote control signal.

According to an embodiment of the lamp unit, at least one drive setting of the light sources comprises a predetermined sequence of drive settings. Thus, the specific drive setting may itself contain a sequence of drive settings such that a predetermined alternating light pattern is achieved for that drive setting, e.g. a blinking pattern, a sequence of colors etc.

According to an embodiment of the lamp unit, the light sources comprise light emitting diodes, LEDs, which is advantageous.

According to an embodiment of the lamp unit, the LEDs are multi LED diodes, e.g. RGB or RGBW.

According to an embodiment of the lamp unit, the lamp unit further comprises a lamp base which is arranged to be fitted in a lamp socket. The lamp unit may for instance to be retrofitted in an existing light fitting or luminaire having such a lamp socket. Thus, the lamp unit according to the present invention may advantageously be used for replacing an incandescent light source or for fitting into a light fixture normally used for incandescent light sources, such as a filamented light bulb, a halogen lamp etc. This is advantageous as a user may conveniently replace expensive and inefficient incandescent light sources in existing luminaires with lamp units in accordance with the present inventive concept. Due to the integrated control unit the functionality of the lamp unit is advantageously applicable in any luminaire into which lamp socket the lamp unit is adapted to fit. The standard type lamp socket may be e.g. a traditional screw socket or a bayonet socket. In the former case, the lamp base is a traditional screw lamp base with suitable threads.

According to another aspect of the invention, there is provided a luminaire comprising at least one lamp unit according to the present inventive concept. When employing a number of lamp units according to the present inventive concept, it is of great importance to be able to reset all lamp units to a predetermined drive setting, which is advantageously achieved with the present inventive concept.

According to an embodiment of the luminaire, a single power switch comprised in the luminaire provides the switching signal to the at least one lamp unit.

According to an embodiment the luminaire further comprises a common control unit arranged for controlling a sequence of drive settings for the at least one lamp unit based on the switching signal. Thus, the switching for the individual lamp units may be further controlled by a common control unit.

According to another aspect of the invention, there is provided a lighting system comprising a plurality of lamp units or a plurality of luminaires. The switching signal is supplied by means of a power switch, or a remote control and at least one corresponding receiver arranged at the lamp units or luminaires.

According to another aspect of the invention, there is provided a method for controlling a plurality of light sources based on a switching signal comprising:

providing a sequence of drive settings for the light sources from which sequence a present drive setting for the light sources is set;

detecting a deactivation of the switching signal;

measuring the elapsed time between the deactivation and a subsequent activation of the switching signal; and if the elapsed time is less than a first predetermined time interval:

setting a subsequent drive setting as present drive setting; or if the elapsed time is more than a second predetermined time interval:

keeping the present drive setting: or if the elapsed time is within a first intermediate time interval arranged between the end of the first predetermined time interval and the end of the second predetermined time interval:

setting the present drive setting to a predetermined drive setting.

According to an embodiment the method further comprises that if the elapsed time is within a second intermediate time interval arranged between the end of the first predetermined time interval and the first intermediate time interval: setting the present drive setting to a second predetermined drive setting. The method may comprise further intermediate time intervals witch respective predetermined drive settings depending on the specific application.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

DETAILED DESCRIPTION

Embodiments according to the present inventive concept will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout.

Figure 1:
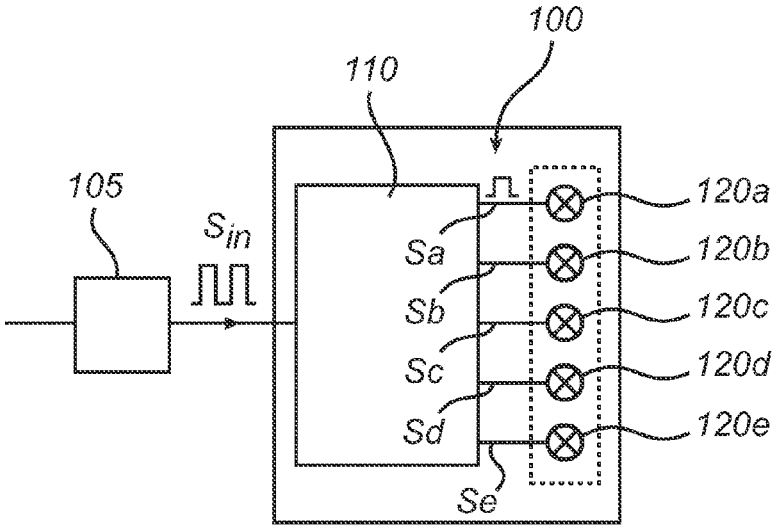
FIG. 1 is a basic block diagram illustrating an embodiment of a lamp unit according to the present inventive concept.

A block diagram illustrating the basic configuration of an embodiment of a lamp unit 100 according to the present invention is illustrated in FIG. 1. The lamp unit 100 comprises a plurality of light sources 120*a-e*, which are arranged to produce light from electricity. The light sources are here light emitting diodes, LEDs, arranged to emit light of different colors or white light. This does not rule out that in some embodiments some of the light sources may be adapted to produce light of the same color. In the context of the present invention, white light is light visually perceptible as white or whitish light, whereas colored light is light other than white having a narrower wavelength spectrum and which light is visually perceptible to humans as for instance red, green, blue, yellow etc. LEDs providing white light may for instance be provided by partial phosphor conversion of light from blue LEDs or by combining LED dies of different color or by combination of phosphors converted blue LEDs and other colored LEDs to tune the color temperature of the white light, whereas the color of the light emitted by color LEDs depends on the composition and condition of the semiconducting material used, as appreciated by the skilled person. Further, a color LED of the present lamp unit may be a package containing multiple dies that emit different colors, such as RGB (Red-Green-Blue) dies, RGB and white or RGB and amber. A color light source of embodiments of the present lamp unit may be a fixed color light source or a variable (multi-die) color light source. Also, a white light source of the present lamp unit may be a fixed color temperature light source or a variable color temperature light source. Further, the light sources may be directional, such that top-emitting and side-emitting functionalities of the LEDs are achieved either by applying appropriate primary optics of the LEDs or intrinsically by the physical configuration of the LEDs. It should be mentioned that other types of suitable light sources are applicable to the present inventive concept of controlled sequenced drive settings even though mainly LEDs are discussed herein.

The light sources 120*a-e* are in communication with a control unit 110 which controls drive settings, Sa-e, of the light sources 120*a-e*. The control unit 110 is further arranged to receive a switching signal, Sin, which here is provided via a power switch 105. The power switch may be a manual power switch operated by a user, or a user operated remote control which sends a switching signal which is received by a receiver (not shown) arranged in the lamp unit. Further, a switching signal may be provided electrically from a lighting system designed to control the lighting in a room, building or area.

Drive settings Sa-e are settings which in a controlled manner provide power to the respective light source 120*a-e*. A drive setting may be static or dynamic (changing in time) and typically concerns voltage levels, current levels, or the frequency of the drive signal. The control unit 110 is further arranged to provide a sequence of drive settings for the light sources, such that several states of drive settings can be provided to the light sources. The drive settings may be chosen to provide e.g. different static or dynamic patterns of powered versus non-powered light sources, different lighting directions when utilizing light sources producing directional light, different colors from the lamp unit, or any combination of the mentioned states. The switching signal is utilized to switch the state of the drive setting of the lamp unit 100.

Figure 2A:
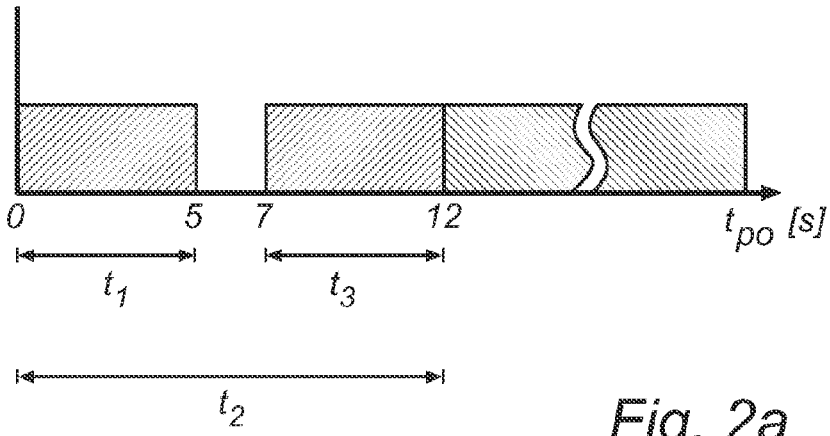
FIGS. 2*a* and *b* illustrate predetermined time periods according to the present inventive concept.

The control unit 110 is arranged to control the present state of the sequence of drive settings based on the switching signal. FIGS. 2*a* and *b* show two examples of timelines for the switching behavior of the lamp unit 100, which illustrate how different states in a drive setting sequence are reached depending on how the switching signal is operated. The x-axis represents time after deactivating the switching signal, which herein after is referred to as switching off the lamp unit. It should be noticed that the switching signal may be provided with a separate switching device, which is not necessarily the power switch. Different states are reached depending on what time $t_{po}$ the switching signal is reactivated after the lamp unit has been switched off. Referring now to FIG. 2*a*, if the switching signal is reactivated within a first predetermined time interval $t_1$, which in this illustrative example is 5 s, the drive setting is set to a subsequent drive setting. By subsequently turning the switching signal off and on within the first predetermined time interval, which is reinitiated at each new off-signal, the user may step through the sequence of drive settings to compare the different resulting light outputs obtained from the lamp unit at the different states.

To continue, if the switching signal is reactivated after a second predetermined time interval $t_2$ has elapsed, which time interval in this illustrative example is 12 s, the drive setting is set to a previous state. That is, if the lamp unit is turned off a sufficient time and then turned on again, the last used drive setting is employed.

An intermediate time interval $t_3$ is arranged between the end of the first time interval $t_1$ and the end of the second interval $t_2$. If the switching signal is reactivated within this intermediate time interval, which here occurs between 7 and 12 seconds after the lamp unit was switched off, the drive setting is set to a predetermined drive setting, which herein after is referred to as the reset state.

Figure 2B:
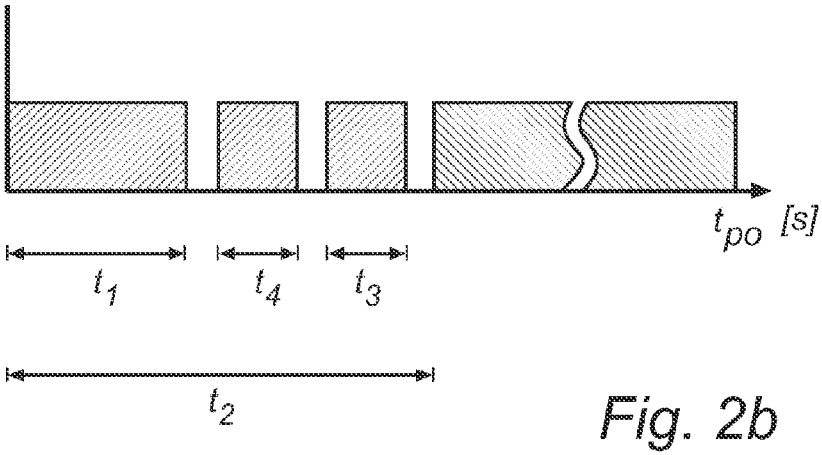

FIG. 2*b* illustrates how the timeline for the switching behavior may contain more than one intermediate time interval, i.e. a time interval arranged between the end of the first time interval $t_1$ and the end of the second interval $t_2$. Here a second intermediate time interval $t_4$ is arranged but the number of intermediate time intervals is preferably set depending on the specific lamp unit and corresponding lighting application. Depending on the application, the time intervals may also overlap.

Figure 3:
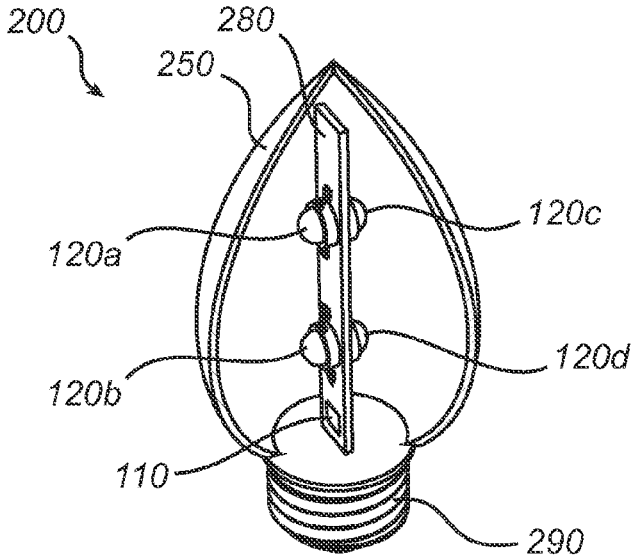
FIG. 3 is a cross-sectional side view of an embodiment of a lamp unit according to the present inventive concept.

FIG. 3 illustrates an exemplifying lamp unit 200 according to an embodiment of the present inventive concept. Four light sources 120*a-d* are mounted two-by-two on the opposite sides of a substrate 280. A control unit 110 is arranged on the substrate and conductive leads to the light sources 120*a-d* are arranged on the substrate (not shown). The substrate is mounted on a traditional lamp base 290 arranged to fit in a screw type socket for (retro) fitting of the lamp unit 200 into an existing luminaire. However, other standard or dedicated lamp sockets could be used. Further, the light sources 120*a-d* on the substrate are enclosed by a glass bulb 250. This type of lamp unit is advantageously utilized in existing luminaires, and will provide the functionality of the inventive concept without any structural alteration of the existing luminaire.

According to an embodiment of the lamp unit (not shown), at least one of the plurality of light sources is a directional light source. Directional light sources are light sources adapted to emit light generally in a specific direction or having a limited output angle, for instance top-emitters, in contrast to omni-directional emitters. A lamp unit may for instance be arranged to emit white light in all directions by means of an omni-directional light source, while emitting blue light in an upwards direction by means of a top-emitter light source. The drive setting sequence for controlling the light of such an exemplifying embodiment, may comprise white light source on-blue light source off, white light source off-blue light source on, white light source on-blue light source on.

Figure 4:
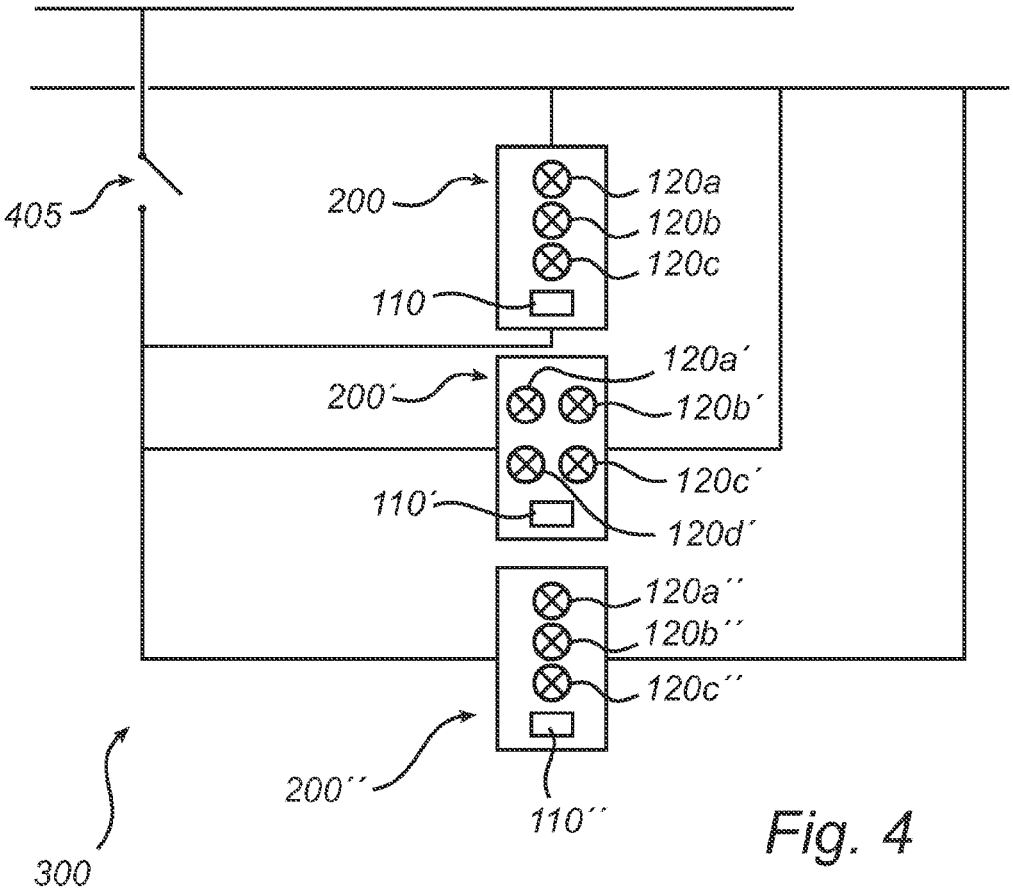
FIG. 4 is a schematic block diagram illustrating an embodiment of a luminaire according to the present inventive concept.
Figures 5, 6:
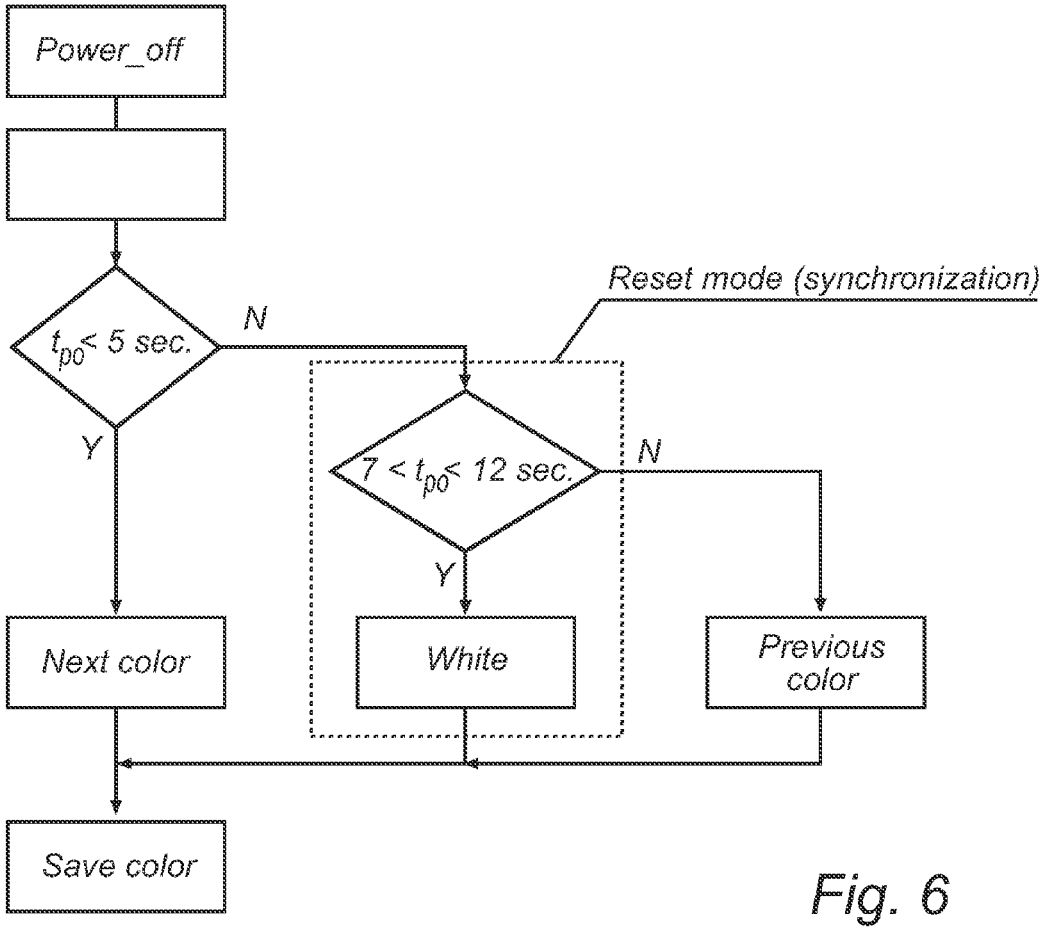
FIG. 5 is a table illustrating exemplifying sequences of drive settings for the embodiment of a luminaire according to the present inventive concept as illustrated in FIG. 4.
FIG. 6 is a flowchart illustrating an exemplifying embodiment of the method according to the present inventive concept.

In FIG. 4 is a schematic illustration of three lamp units 200, 200', 200" arranged in a luminaire 300 which has a power switch 405. The lamp units 200, 200', 200" comprise a different number of light sources, 120*a-c*, 120'*a-d*, 120"*a-c*, and their respective control unit 110, 110', 110" is arranged to control the respective light sources with different sequences of drive settings, as illustrated in FIG. 5. Lamp unit 200 has seven selectable states of drive settings, and state [1 1 1], is selected to be the reset state. Lamp unit 200' has five selectable states, and state [1 1 1 1] is selected to be the reset state of the lamp unit 200'. Lamp unit 200" has six selectable states which each state steps through three states. State [010, 101, [111]] is selected as reset state for lamp unit 200". As the power switch 405 is operated, taking into account the timeline for the switching behavior of the lamp unit as described above with reference to FIG. 2, it is readily understood that a wide variety of light outputs from the luminaire 300 is achievable due to the many states achievable for the individual lamp units 200, 200', 200" and their combined states, and due to the non-synchronization of drive settings of the lamp units. The reset state then offers a synchronization of the lamp units to an initial selection of desired driving states.

The timeline switching behavior as illustrated in FIG. 2 may be indicated to the user by providing for instance a remote control power switch with LED-lights for indicating the different time intervals. The first predetermined time interval may for instance be indicated with a green light and the third predetermined time interval for resetting the drive settings may be indicated with a blue light. This way the user can in an intuitive way step through and select the desired drive setting during the presence of the green light, or wait until the blue light and reset the drive settings. If the user waits until the green light and the blue light is off, the previously selected drive settings will be reemployed when the lamp unit is switched on.

In FIG. 6 a flow chart illustrating a method according to the present inventive concept is presented. This method for controlling a plurality of light sources may be utilized in a lamp unit or in a luminaire as described above, and is further based on a switching signal, which may be provided from the power switch of the lamp unit or the luminaire. The method comprises providing a sequence of drive settings for the light sources from which sequence a present drive setting is initially selected and set. When the power is switched off this is detected, i.e. detecting a deactivation of the switching signal is performed. Next, the measuring of the elapsed time between the deactivation and a subsequent activation, $t_{po}$, of said switching signal is performed. If the elapsed time $t_{po}$ is less than a first predetermined time interval, which is set to 5 sec in FIG. 6, a subsequent drive setting, here the next color/state, is set as present drive setting for the light sources. Here a state may represent a color or a light pattern/functionality, e.g. dimming. If the elapsed time $t_{po}$ is more than a second predetermined time interval the present drive setting is kept (previous color/state). However, if the elapsed time $t_{po}$ is within an intermediate time interval, 7-12 sec, arranged between the end of the first predetermined time interval, 5 sec, and the end of the second predetermined time interval, 12 sec, the present drive setting is set to a predetermined drive setting, white/state. The third time interval is here set between 7 and 12 seconds. The first, second and intermediate time intervals may be chosen in various manners and are preferably adjusted to fit the current lighting application.

According to an embodiment of the lamp unit, at least one of the plurality of light sources emits light in a direction separate from light emitting direction of the remaining plurality of light sources. Several light emitting directions of light from the lamp unit, which light in some embodiments also emit light of different colors, and light sources that are set according to a sequence of drive settings allows for a high degree of flexibility of the lighting achieved by the lamp unit. This does not only apply to color choice but further the functionality of the light is easily altered, e.g. between a spotlighting- or background lighting functionality, or a combination of both.

In an exemplifying embodiment of a lamp unit according to the present inventive concept, the lamp unit is designed to be employed in a bed reading lamp. The lamp unit (not shown) is arranged such that it can provide task light (color is e.g. amber) or atmosphere light (color is white), or both task- and atmosphere light simultaneously. The bed reading lamp further has a common power switch to which the lamp unit is arranged to respond. When the bed reading lamp is switched off and subsequently turned on again, the time elapsed between the deactivation and the activation of the switching signal, $t_{op}$, will provide different functionalities of the reading lamp in accordance with the following:

$t_{op}<5$ s→light is switched to next color/state.

$5<t_{op}<7$ s→bed reading light function is selected. In this state the light output will be is dimmed (from 100% light output to 0% light output).

$7<t_{op}<13$ sec.→the lamp unit is reset to white light.

$t_{op}>13$ sec.→light is switched to its previous color/state. Thus depending on the required functionality, additional time intervals may be introduced for the lamp unit. Further, if a plurality of lamp units is arranged in a common luminaire or a lighting system, the individual time intervals for the lamp units may differ such that for the user, the number of active time intervals may be perceived as higher than it is for the individual lamp units.

The person skilled in the art realizes that the present invention by no means is limited to the preferred embodiments described above. On the contrary, many modifications and variations are possible within the scope of the appended claims.

The invention claimed is:

1. A lamp unit comprising:

a plurality of light sources;

a control unit adapted to control a sequence of drive settings for said plurality of light sources based on a switching signal supplied to the lamp unit;

wherein said control unit is arranged such that:

if the switching signal is deactivated and within a first predetermined time interval is subsequently reactivated, a subsequent drive setting of said light sources is employed, or else if the switching signal is deactivated and after a second predetermined time interval, is subsequently reactivated, a previous drive setting of said light sources is employed, or else if the switching signal is deactivated and within a predetermined first intermediate time interval, arranged between the end of said first predetermined time interval and the end of said second predetermined time interval, is subsequently reactivated, a predetermined drive setting is employed.

2. A lamp unit according to claim 1, wherein said control unit is further arranged such that if the switching signal is deactivated and within a predetermined second intermediate time interval, arranged between the end of said first predetermined time interval and the first intermediate time interval, is subsequently reactivated, a predetermined drive setting is employed.

3. A lamp unit according to claim 1, wherein said light sources are adapted to emit light of different colors.

4. A lamp unit according to claim 1, wherein said switching signal is supplied by means of a power switch, or a remote control and a corresponding receiver arranged in said lamp unit.

5. A lamp unit according to claim 1, wherein at least one drive setting of said light sources comprises a predetermined sequence of drive settings.

6. A lamp unit according to claim 1, wherein said light sources comprise light emitting diodes.

7. A lamp unit according to claim 6, wherein said light sources are multi LED diodes.

8. A lamp unit according to claim 1, further comprising a lamp base which is arranged to be fitted in a lamp socket.

9. A luminaire comprising at least one lamp unit according to claim 1.

10. A luminaire according to claim 9, wherein a single power switch comprised in said luminaire provides said switching signal to said at least one lamp unit.

11. A luminaire according to claim 9, further comprising a common control unit arranged for controlling a sequence of drive settings for said at least one lamp unit based on said switching signal.

12. A lighting system comprising a plurality of lamp units according to claim 1, wherein said switching signal is supplied by means of a power switch, or a remote control and at least one corresponding receiver arranged at said lamp units.

13. A lighting system comprising a plurality of luminaires according to claim 10, wherein said switching signal is supplied by means of a power switch, or a remote control and at least one corresponding receiver arranged at said luminaires.

14. A method for controlling a plurality of light sources based on a switching signal comprising:

providing a sequence of drive settings for said light sources from which sequence a present drive setting for said light sources is set;

detecting a deactivation of said switching signal;

measuring the elapsed time between said deactivation and a subsequent activation of said switching signal; and if said elapsed time is less than a first predetermined time interval:

setting a subsequent drive setting as present drive setting; or if said elapsed time is more than a second predetermined time interval:

keeping said present drive setting: or if said elapsed time is within a first intermediate time interval arranged between the end of said first predetermined time interval and the end of said second predetermined time interval:

setting said present drive setting to a predetermined drive setting.

15. A method according to claim 14, said method further comprising if said elapsed time is within a second intermediate time interval arranged between the end of said first predetermined time interval and the first intermediate time interval:

setting said present drive setting to a predetermined drive setting.

* * * * *